United States Patent [19]

Johnston

[11] Patent Number: 4,955,436

[45] Date of Patent: Sep. 11, 1990

[54] SEAL APPARATUS

[76] Inventor: Vaughn R. Johnston, 240 Kelley Rd., Washington, Pa. 15301

[21] Appl. No.: 451,608

[22] Filed: Dec. 18, 1989

[51] Int. Cl.[5] ..... E21B 33/02

[52] U.S. Cl. ..... 166/82; 166/84; 175/195; 277/31; 277/192

[58] Field of Search ..... 166/81–84, 166/75.1, 85; 175/195, 84; 15/102, 210 B; 277/30, 31, 101, 192, 197, 198

[56] References Cited

U.S. PATENT DOCUMENTS

| | | | |
|---|---|---|---|
| 1,989,429 | 1/1935 | Segelhorst et al. | 251/1.3 X |
| 2,328,127 | 8/1943 | Crickmer | 277/6 |
| 2,522,444 | 9/1950 | Grable | 166/81 |
| 2,850,754 | 9/1958 | Davis | 15/210 B |
| 3,329,987 | 7/1967 | Grant | 15/210 B |
| 3,400,938 | 9/1968 | Williams | 277/31 |
| 3,422,483 | 1/1969 | Craycraft | 15/210 B |
| 3,724,862 | 3/1973 | Biffle | 277/31 |
| 3,965,987 | 6/1976 | Biffle | 166/315 |
| 4,208,056 | 6/1980 | Biffle | 277/31 |
| 4,345,769 | 8/1982 | Johnston | 277/31 |
| 4,361,185 | 11/1982 | Biffle | 166/84 |
| 4,363,357 | 12/1982 | Hunter | 166/84 |
| 4,423,776 | 1/1984 | Wagoner et al. | 166/84 |
| 4,428,592 | 1/1984 | Shaffer | 251/1.2 X |
| 4,441,551 | 4/1984 | Biffle | 166/84 |
| 4,486,025 | 12/1984 | Johnston | 277/31 |
| 4,531,591 | 7/1985 | Johnston | 175/57 |
| 4,658,894 | 4/1987 | Craig | 166/84 |

*Primary Examiner*—Hoang C. Dang

*Attorney, Agent, or Firm*—Carothers & Carothers

[57] ABSTRACT

A stripper rubber or rubber seal apparatus such as used in drilling operations which includes a pair of transversely mating rubber elements which are cooperable to encompass a drill string and are carried by a diametrically split clamp ring that is engageable with a mounting ring carried by the drilling apparatus in a manner that the mating rubber elements may be brought simultaneously into sealing engagement with the mounting ring and into mating sealed engagement with each other about a drill pipe or other ancillary structure such as a rotary drive bushing.

10 Claims, 2 Drawing Sheets

SEAL APPARATUS

BACKGROUND OF THE INVENTION

In the drilling arts there are known a wide variety of resilient seals which are used to seal about the perimeter of a drill string for various purposes. Such seal assemblies are known by various designations depending upon their intended function, including stripper rubbers, wiper rubbers, packers and blow-out preventers.

The prior art is replete with examples of such sealing apparatus. For example, U.S. Pat. No. 4,531,591 discloses a rotary spindle assembly which includes a resiliently flexible packer. U.S. Pat. No. 4,345,769 discloses a stripper packer which is attached by screw threads to the lower end of a rotary tubular member so as to form a seal between the stripper packer and the tubular member. U.S. Pat. No. 4,486,025 discloses another such seal structure wherein axially extending retention bolts retain a resilient seal member in compression between axially opposed ring elements.

U.S. Pat. No. 3,400,938 discloses a drilling head assembly with a generally conical rubber seal having reinforcements in the form of elongated biasing springs. This patent additionally discloses a clamp or retention ring apparatus formed generally as semi-circular clamp elements which are pivotally connected together adjacent one end and are adapted to accommodate a retention bolt or similar retainer adjacent the opposed ends of the semi-circular ring elements. U.S. Pat. No. 3,965,987 discloses a circumferential clamp ring which employs a wedging action to draw two rigid members axially together, one of which members is a portion of an assembly carrying coaxially arranged rubber seals.

Some of the above characterized structural features are also disclosed in U.S. Pat. Nos. 4,208,056, 3,724,862, 4,658,894, 4,363,357, 4,361,185, 4,441,551 and 4,423,776.

The operations necessary to install such seal assemblies about a drill string in properly sealed engagement with both the drill string and the carrier apparatus have significantly increased the non-productive time element in drilling operations and thus the expense of drilling. For example, stripper rubber change-out has commonly required that a drill string joint be broken apart before the stripper rubber could be removed and replaced. Therefore, the art has continually sought improvements in seal structures such as those characterized above to reduce the difficulty and time consumption involved in their utilization.

BRIEF SUMMARY OF THE INVENTION

The present invention contemplates a novel seal apparatus for drilling operations. The apparatus according to one presently preferred embodiment of the invention includes a pair of reinforced stripper rubber elements which mate along a generally tranverse mating line. The mating halves of the reinforced stripper rubber are mounted upon the respective semi-circular halves of a clamp ring assembly which are pivotally connected together to permit the clamp ring halves, and the stripper rubber elements carried thereby, to be opened and closed about a drill string.

The clamp ring structure includes a camming or wedging surface which cooperates with a retention or mounting structure such as a flanged ring carried by the drilling apparatus to axially compress a perimeteral portion of the stripper rubber into continuous circumferential sealing engagement with a cooperating surface of the mounting ring. The clamp wedging action is achieved by drawing the clamp ring halves radially together under a cooperating, radially outwardly projecting flange of the mounting ring. The radial movement of the clamp ring halves also draws the confronting mating surfaces of the stripper rubber elements into mutually biased engagement to provide a sealed interface therebetween through compressive deformation of the stripper rubber elements along the generally diametrically extending interface therebetween.

The invention thus affords greatly improved ease and efficiency of stripper rubber installation and use thereby reducing the cost and increasing the overall efficiency of drilling operations. The invention is intended for use primarily for such drilling operations as blast hole and water well drilling, monitor or core drilling, and the like.

It is therefore one object of the invention to provide a novel and improved stripper rubber apparatus for use in drilling operations.

A further object of the invention is to provide a split stripper rubber assembly having a perimeteral clamp ring which is operative upon engagement of a retention ring portion of a drilling apparatus to simultaneously seal the stripper rubber on the drilling apparatus carrier and about the drill string, and additionally along the generally diametrical or transverse parting or mating line of the stripper rubber elements.

These and other objects and further advantages of the invention will be more readily appreciated upon consideration of the following detailed description and the accompanying drawings, in which.

Figure 1:
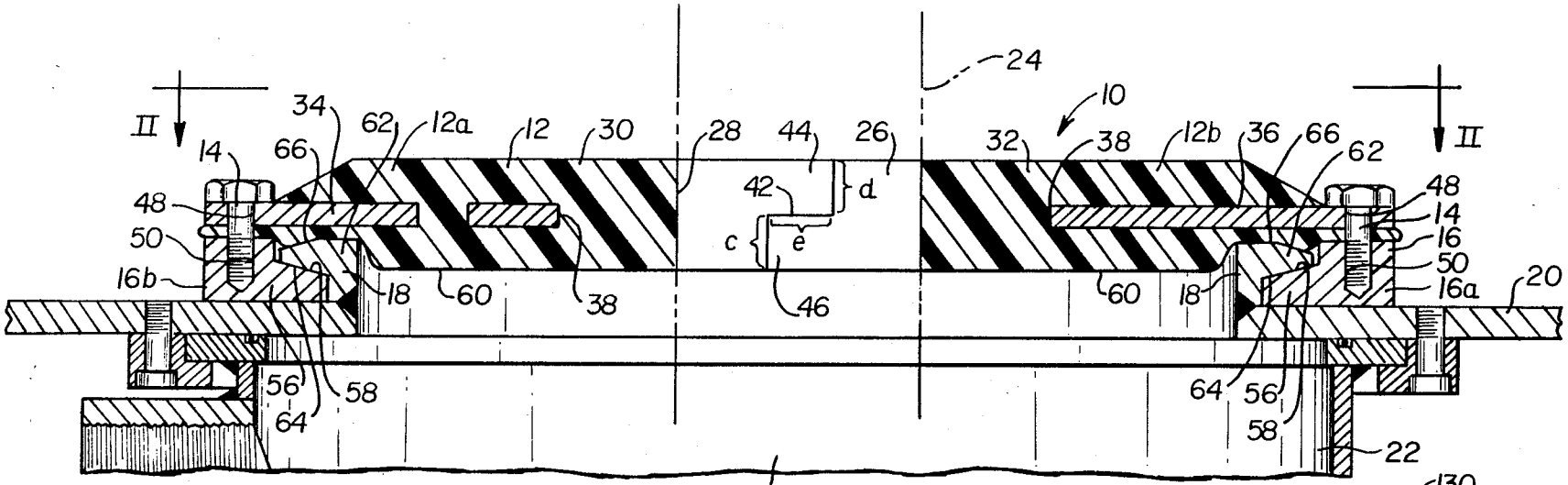
FIG. 1 is a sectioned side elevation of a stripper rubber assembly according to one presently preferred embodiment of the instant invention and taken generally on line I—I of FIG. 2.
Figure 2:
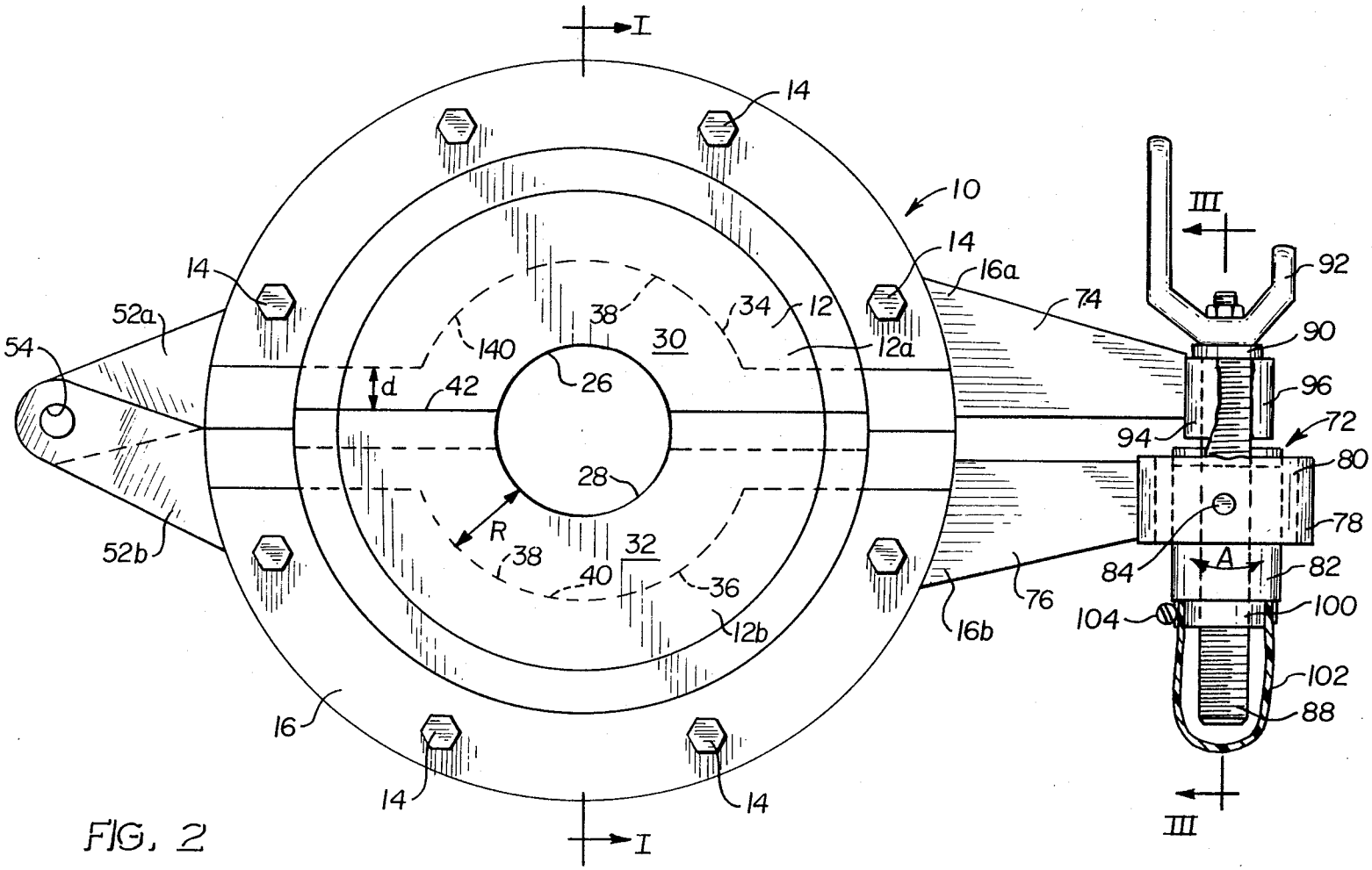
FIG. 2 is a top plan view of a stripper rubber assembly as seen from line II—II of FIG. 1.

There is generally indicated at 10 in FIGS. 1 and 2 a rubber seal apparatus constructed according to one presently preferred embodiment of the instant invention and comprising a resiliently flexible, reinforced seal assembly 12 which is affixed as by a plurality of suitable fasteners such as bolts 14 to a clamp ring assembly 16. Clamp ring assembly 16 is engageable with a cooperating retention or mounting ring portion 18 of a drilling rig frame 20, which may also support a depending diverter apparatus 22 or other known ancillary structures.

In practice, a drill string 24 extends axially through a center opening 26 in seal assembly 12 and is maintained in sealed engagement with a cylindrical side wall 28 of opening 26. Since the entire seal assembly 10 is fixedly retained with respect to base or frame 20 when clamp ring 16 is engaged upon mounting ring 18, the drill string 24 rotates with respect thereto in rotary drilling operations. Accordingly, a rotary sliding, sealed interengagement is maintained between the drill string 24 and side wall surfaces 28 of opening 26 to thereby provide a seal against the upward movement of drilling mud and other drilling debris which is ejected upwardly from the mouth of the bore hole during drilling operations.

Seal 12 is comprised of a pair of mating, generally semi-circular elements 12*a* and 12*b* of elastomeric material such as rubber. Seal elements 12*a* and 12*b* are comprised of generally planer and semi-circular elastomeric elements designated 30 and 32, respectively, and respective generally planer, rigid reinforcing plate members 34 and 36 of plate steel, for example, which are at least partially embedded in the respective elastomeric members 30 and 32.

Each reinforcing plate 34 and 36 is formed generally as a semi-circle to conform with the above described semi-circular geometry of elements 30 and 32; however, each elastomeric element 30 and 32 projects radially inward (with respect to the assembled configuration of seal assembly 12 as shown in FIG. 2) beyond the radially innermost extent 38 of the respective reinforcing plates 34 and 36. More particularly, each of reinforcing plates 34 and 36 includes a radially outwardly projecting relief or recess 40 which defines the radially innermost extent of the respective reinforcing plates 34 and 36 in the area thereof encompassing opening 26. The reinforcing plates 34 and 36 thus extend no closer than a predetermined radial distance R toward the perimeter 28 of opening 26, and the radially intervening portion of elastomeric elements 30 and 32 is free to be laterally compressed and thereby resiliently deformed into compressive sealed engagement about drill string 24.

Similarly, a parting or mating interface 42 extends generally diametrically of the semi-circular elastomeric elements 30 and 32 and defines a zone of sealed engagement therebetween, and in the regions laterally adjacent to the interface 42 the reinforcing plates 34 and 36 are configured to approach the interface 42 no closer than a predetermined distance d. Accordingly, throughout the entire length of interface 42 adjacent portions of elastomeric elements 30 and 32 are free to be laterally compressed and thereby resiliently deformed into compressive face sealing engagement. As shown in FIG. 1, interface 42 is comprised of surfaces of mutual engagement between mutually engageable step portions 44 and 46 of elastomeric elements 30 and 32, respectively.

Clamp ring 16 is comprised of a pair of generally semi-circular rigid clamp ring elements 16*a* and 16*b* to which the respective seal assemblies 12*a* and 12*b* are affixed by means of the bolts 14 which pass through suitably formed apertures 48 formed in the respective reinforcing plates 34 and 36, and are threadedly engaged within suitably threaded corresponding blind bores 50 in the clamp ring elements 16*a* and 16*b*.

Each clamp ring element 16*a* and 16*b* is provided with a respective pivot arm 52*a*, 52*b* which projects from the respective clamp ring element 16*a*, 16*b*. Arms 52*a*, 52*b* are pivotally affixed together adjacent their outermost ends as by a suitable pivot pin 54, and ring elements 16*a* and 16*b* thus may be pivotally moved toward and away from one another in a generally radial direction, whereby the seal elements 12*a* and 12*b* may be brought selectively into or out of engagement with one another along interface 42.

Each clamp ring element 16*a* and 16*b* also includes a radially inwardly projecting flange portion 56 which has a sloping engagement surface 58 that diverges in the radially inward direction from an adjacent or confronting exterior surface 60 of the respective seal elements 12*a* and 12*b*. Retention ring 18 includes a complementary, radially outwardly projecting flange portion 62 having a sloping or inclined undersurface 64 which is configured to engage surfaces 58 of the clamp ring elements 16*a* and 16*b* such that upon closure of clamp ring elements 16*a* and 16*b* by drawing them together about pivot 54, flanges 56 thereof may be engaged and positively retained beneath the retention ring flange 62.

The thickness in the vertical direction of the flange 62 is greater than the corresponding clearance between clamp ring surfaces 58 and the confronting exterior surface 60 in its undeformed state. Accordingly, upon engaging clamp ring elements 16*a* and 16*b* beneath flange 62, the interengagement of respective surfaces 58 and 64 causes clamp ring elements 16*a* and 16*b* to be drawn downward with respect to flange portions 62 as the clamp ring elements 16*a* and 16*b* are drawn radially into engagement under flange 62. Accordingly, the upper surfaces 66 are forced into compressive engagement with radially outer perimeteral portions of exterior surface 60 thereby compressively deforming adjacent portions or regions of seal elements 12*a* and 12*b* into sealing engagement with surface 66 and creating a continuous perimeteral sealed interface between seal assembly 10 and the retention ring structure 18.

Upon drawing the clamp elements 16*a* and 16*b* into engagement with retainer ring 18 as above described, a compressive face seal is also formed extending continuously along the length of interface 42 between seal elements 12*a* and 12*b*. Specifically, the diameter of seal elements 12*a* and 12*b*, when engaged but not compressed along interface 42, is greater in the direction extending perpendicular to the diameter on which interface 42 extends than the corresponding diametrical dimension of the compressively engaged seal elements 12*a* and 12*b* when clamp ring 16 is fully engaged with retention ring 18. Accordingly, upon drawing clamp ring 16 fully into engagement with retention ring 18, the confronting or abutting surfaces of seal elements 12*a* and 12*b* which form interface 42 are drawn into compressive engagement along portions c and d of interface 42. Additionally, the resulting compression of the respective step portions 44 and 46 causes these portions to bulge outwardly thereby creating a compressive face seal in region e of interface 42. A continuous, compressive face sealing engagement thus is established and maintained between the seal elements 12*a* and 12*b* throughout the entire mutually contiguous extent of the surfaces defining interface 42. By judicious selection of the diameter for opening 26, a suitable compressive sealing engagement may by the same means also be provided about drill string 24, thus completely sealing the area within the interior 70 of diverter 22 from the drilling apparatus above seal assembly 10.

Figure 3:
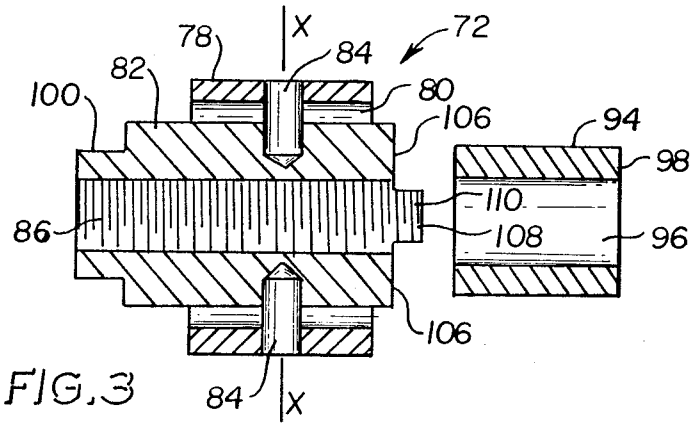
FIG. 3 is a sectioned side elevation of a clamp actuating screw apparatus taken on line III—III of FIG. 2, and with the clamping screw removed to more clearly show details of the structure.

In order to facilitate drawing the clamp ring halves 16*a* and 16*b* together in engagement with flange 18, a screw clamp assembly generally indicated at 72 in FIG. 2 and FIG. 3 is provided. Screw clamp assembly 72 comprises a pair of projecting arms 74 and 76 which extend from the respective clamp ring segments 16*a* and 16*b* in a diametrical direction opposed to the extent of pivot arms 52*a* and 52*b*. A fabricated cage or housing 78 is rigidly affixed to the outermost end of arm 76 and includes a generally square or rectangular section through opening 80 within which is disposed a threaded nut 82. Nut 82 is pivotally retained with respect to housing 78 by means of suitable, vertically disposed pivot axes 84 so that the threaded nut 82 is pivotally movable about a vertical axis X—X, in the directions indicated by arrow A in FIG. 2, to the limits of such movement permitted by the clearance available within the open interior 80 of housing 78.

Nut 82 includes a threaded through bore 86 in which there is threadedly engaged an elongated cooperably threaded rod 88. One end of threaded rod 88 extends from nut 82 and includes a thrust washer portion 90 and a crank handle 92 which is utilized for manually turning rod 88 in threaded nut 82.

The arm 74 has a bearing 94 rigidly affixed adjacent an outer end thereof generally in alignment with threaded bore 86 of nut 82. Bearing 94 includes an open side 96 which faces laterally outward and is of a sufficient width to receive threaded rod 88 such that the rod 88 may be moved into and out of engagement with bearing 94 by pivoting the rod 88, when engaged in nut 82, laterally outward.

With rod 88 disengaged from bearing 94, the clamp ring segments **16*a* and 16*b* are free to be pivoted apart about pivot axis 54 to thereby release the clamp ring 16, and thus seal assembly 10, from both the retention ring 18 and the drill string 24. To reinstall apparatus 10 about the drill string 24 and on retention ring 18 in sealed engagement with both, it is necessary only to position the radially innermost extent of flange 56 of the clamp ring elements 16*a* and 16*b* in engagement under the radially outermost portion on flange 62 of the retention ring 18. The crank handle 92 may then be turned to back threaded rod 88 out sufficiently to provide clearance for pivoting the rod 88 into the confines of bearing element 94 through open side 96 such that thrust washer 90 is engageable upon a bearing surface 98 of bearing 94. Upon then turning crank 92 to advance rod 88 through nut 82, thrust washer 90 forcefully engages bearing surface 98 and draws the nut 82 and bearing 94 together. Through the rigid connection of these elements via arms 74 and 76 with clamp ring elements 16*a* and 16*b*, the clamp ring halves 16*a* and 16*b* also are drawn together and flange portions 56 are drawn progressively down the slope of the flange surface 56 as above described to quickly and conveniently seal the apparatus 10 not only about the drill string 24, but additionally along the diametrical interface 42 between the seal elements 12*a* and 12*b*, and about the perimeter of the seal elements 12*a* and 12*b* where they engage the upper surface 66 of retainer ring flange 62**.

Dirt and debris are a constant problem in drilling operations and could result in damage to the interengaged threads of rod 88 and nut 82 in operation. Accordingly, to protect the threads of these components from contamination, a boss 100 may be provided on the outermost end of nut 82 to receive an open ended flexible boot 102 (FIG. 2), which is then retained with respect to boss 100 as by a conventional flexible pipe clamp 104. The boot 102 encloses the projecting end of threaded rod 88 to protect the threads thereof from contamination.

Adjacent the opposed end of nut 82, diametrically opposed portions, such as upper and lower portions 106 are removed as by milling to leave an intervening portion 108 on laterally opposed sides of the nut 82. The portions 108 have thereon confronting threaded segments 110 which are engageable with the threads of rod 88 in the same manner as are the threads in bore 86. Threads 110 thus provide a self-cleaning action as rod 88 is turned in engagement with them to dislodge contamination from the threads of rod 88. The contaminants then drop downward and are not carried into bore 86.

Figure 4:
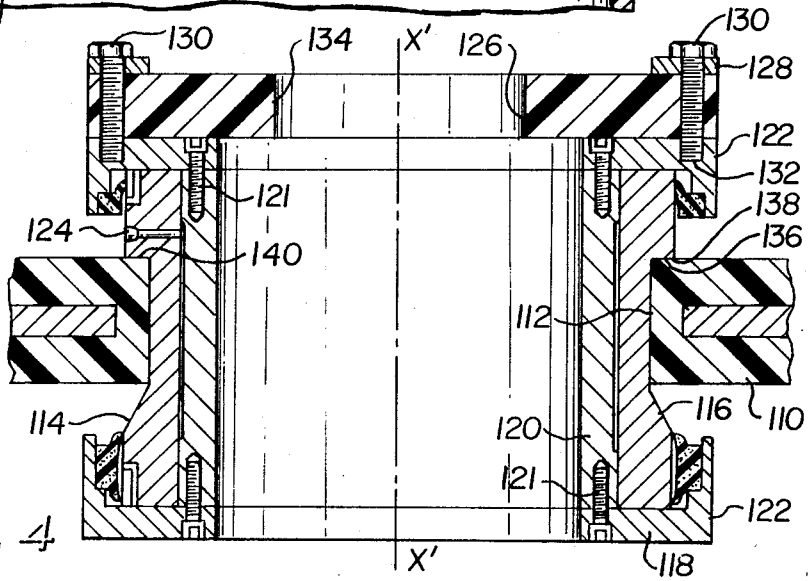
FIG. 4 is a sectioned side elevation showing an alternative embodiment of the invention.

An alternative embodiment of the invention as shown in FIG. 4 includes a rubber seal structure substantially as above disclosed with reference to FIGS. 1 through 3 but including a reinforced rubber seal 110 having a central opening 112 which encloses a rotary drive bushing assembly 114.

In the above described embodiments, a drill pipe or similar structure extends through the central opening in the rubber seal which then seals the exterior periphery of a cylindrical drill pipe in rotary sealing engagement. That is, the stripper rubber is rotationally stationary with respect to the drill pipe which rotates about its longitudinal axis in operation.

For such embodiments of the invention, the sealing engagement of the stripper rubber about the cylindrical drill pipe is entirely satisfactory; however, a drill string typically may not be uniformly cylindrical. For example, wrench flats typically are formed adjacent the opposed longitudinal ends of each drill pipe section to accommodate wrench application for making up or breaking apart the drill pipe sections. Additionally, in some drilling rigs the drill string includes a square or hexagonal kelly which is engageable in a rotary drive head to drive the drill string in rotation. Accordingly, there are portions of a drill string that must pass through the stripper rubber as disclosed hereinabove which are not cylindrical but instead are polygonal or a combination of planer and arcuate surfaces. Rotation of such non-cylindrical drill string cross-sections against the cylindrical side wall of the central opening in the stripper rubber will quickly destroy the seal integrity and lead to premature failure and frequent need of stripper rubber replacement.

In order to avoid this problem, the stripper rubber of this invention may enclose and support the rotary drive bushing assembly 114 which is comprised of a rotationally stationary housing 116 that carries a rotary bushing assembly 118 therein for rotation with respect to the housing 116 on an axis X'—X'.

The bushing assembly 118 includes a cylindrical inner bearing sleeve 120 that extends axially within housing 116 and is retained therein by a pair of axially opposed end flanges 122 which are retained with respect to sleeve 120 by plurality of bolts 121. The interfacing cylindrical surfaces between bushing assembly 118 and housing 116 form a sleeve type rotary bearing which is lubricated to facilitate relative rotation therebetween via a lubrication port 124. A rubber seal 126 is retained coaxially adjacent one of the end flanges 122 by means of a retention ring 128 and threaded fasteners such as bolts 130 which extend through suitably formed apertures on a bolt circle in flange 128, through corresponding registered apertures in seal 126 and are retained in threaded engagement within blind bores such as at 132 in the respective end flange 122.

The seal 126 includes a central cylindrical opening 134 through which a drill string may extend. Since the bushing assembly 118 is relatively rotatable with respect to housing 116, the seal 126 mounted thereon is free to rotate with a drill string against which surface 134 is sealed. Accordingly, in operation the only relative motion between seal 126 and the drill string, even during drill string rotation, will be relative vertical sliding. The seal 126 thus is far better adapted to accommodate movement through opening 134 of non-cylindrical drill string sections such as wrench flats or kelly bars.

To change out a seal 126 as the need arises it is necessary only to open the mated halves of rubber seal 110 as above described with reference to FIGS. 1 through 3. Drive busing assembly 114 then may be removed and replaced with another similar assembly having a fresh seal 126 installed thereon. The drive bushing assembly 114 removed from seal 110 is then available for replacement of the seal 126 thereon or other maintenance service, and it may then may be held at the drilling site to be used as a further replacement when the installed drive bushing assembly 114 requires servicing.

From the above description, it will be appreciated that the rubber seal 110 functions as more than just a rotary seal on a drill string, specifically as regards the embodiment of FIG. 4 it may also function as a clamp and support structure for such apparatus as a rotary drive bushing, the peripheral surface 112 being maintained in tight clamping engagement about the periphery of housing 116. Additionally, the housing 116 is supported vertically by rubber seal 110 by virtue of an undercut 136 which forms a radially outwardly projecting annular flange 138 on the exterior periphery of housing 116. Flange 138 engages a corresponding annular upper surface portion 140 of rubber seal 110 which encompasses the opening 112.

According to the description hereinabove, there is provided by the instant invention a novel and improved seal apparatus for use in drilling operations to afford greatly enhanced efficiency and convenience of use as well as enhanced seal integrity. Of course, I have contemplated various alternative and modified embodiments of the invention other than those described hereinabove, and such would certainly also occur to others versed in the art, once apprised of my invention. Accordingly, it is intended that the invention be construed broadly and limited only by the scope of the claims appended hereto.

I claim:

1. A resiliently flexible seal assembly adapted to be mounted with respect to a seal mounting portion of a drilling rig to enclose the circumferential periphery of an elongated drilling apparatus comprising:

a pair of resiliently flexible members;

said resiliently flexible members having respective first sealing surface portions which are mutually engageable and second sealing surface portions which are mutually cooperable to enclose the circumferential periphery of such a drilling apparatus when said first sealing surface portions are mutually engaged;

a pair of rigid support members affixed with respect to said resiliently flexible members, respectively, to support said resiliently flexible members with said first sealing surface portions in mutually confronting relation and to selectively move said first sealing surface portions into said mutual engagement and said second sealing surface portions into said enclosing relation about the circumferential periphery of such a drilling apparatus;

said first sealing surface portions being cooperable upon movement thereof into said mutual engagement to maintain mutually sealed interengagement therebetween with said second sealing surface portions in enclosing relation about the circumferential periphery of such a drilling apparatus and;

each said rigid support member including a surface means which is cooperable with such a seal mounting portion of a drilling rig to move portions of said resiliently flexible members into sealing engagement with such a seal mounting portion upon said moving of said first sealing surface portions into said mutual engagement.

2. The seal assembly as set forth in claim 1 wherein each of said resiliently flexible members includes a body of resiliently flexible material and a rigid reinforcing means at least partially embedded in said body of resiliently flexible material.

3. The seal assembly as set forth in claim 2 wherein said rigid reinforcing means is spaced laterally from said first and second sealing surface portions.

4. The seal assembly as set forth in claim 3 additionally including pivot axis means pivotally connecting said rigid support members together to permit relative pivotal movement of said rigid support members and the respective said resiliently flexible members supported thereby to accommodate said moving of said first sealing surface portions into and out of said mutual engagement.

5. The seal assembly as set forth in claim 4 wherein each of said rigid support members is a generally arcuate member and said surface means of each said support member includes a surface of an arcuate, radially inwardly projecting flange means which is adapted to engage a cooperating surface of such a seal mounting portion of a drilling rig to retain said seal assembly with respect to such a drilling rig.

6. The seal assembly as set forth in claim 1 wherein, when said first sealing surface portions are mutually engaged, said resiliently flexible members define a generally circular form with said first sealing surface portions extending generally radially thereof.

7. The seal assembly as set forth in claim 6 wherein, when said first sealing surface portions are mutually engaged, said second sealing surface portions define an aperture which is adapted to confine the external periphery of such a drilling apparatus.

8. The seal assembly as set forth in claim 7 wherein each said first sealing surface portion includes an elongated formed surface extending generally diametrically of said generally circular form and having a length substantially coextensive with a diameter of said circular form and including a first elongated surface portion having opposed longitudinal edges and respective second and third elongated surfaces which extend from said opposed longitudinal edges, respectively, at a given angle with respect to said first surface and are longitudinally coextensive therewith.

9. A seal assembly adapted for use with a drilling rig to enclose the circumferential periphery of a drill string comprising:

a pair of resiliently flexible members;

said resiliently flexible members having respective first sealing surface portions which are mutually engageable and second surface portions which are cooperable in a manner to enclose the circumferential periphery of a bushing assembly when said first sealing surface portions are mutually engaged;

a bushing assembly adapted to be enclosed by said second surface portions, said bushing assembly including a rigid housing having a circumferential periphery adapted to be enclosed by said second surface portions and a resiliently flexible seal having a central through opening for receiving a drill string;

means for supporting said resiliently flexible members with said first sealing surface portions and said second surface portions, respectively, in mutually confronting relation and for selectively moving said first sealing surface portions into mutual interengagement and said second surface portions into enclosing relationship about said circumferential periphery of said bushing assembly; and means for compressively deforming said resiliently flexible members by forceful mutual interengagement of said first sealing surface portions to maintain said resiliently flexible members in mutually sealed interengagement and in enclosing relation about said circumferential periphery of said bushing assembly.

10. The seal assembly as set forth in claim 9 wherein said bushing assembly includes a rigid housing having said circumferential periphery formed externally thereon and a rotary bushing means rotatably carried by said housing and including said resiliently flexible seal disposed thereon such that said resiliently flexible seal is rotatable with respect to said housing about the axis of said through opening.

* * * * *